US009618205B2

(12) United States Patent
Blessing et al.

(10) Patent No.: US 9,618,205 B2
(45) Date of Patent: Apr. 11, 2017

(54) GAS FLOW CONTROLLER FOR USE IN GAS FIRED APPARATUS

(71) Applicant: Emerson Electric Co., St. Louis, MO (US)

(72) Inventors: Donald L. Blessing, Manchester, MO (US); Mark H. Stark, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 456 days.

(21) Appl. No.: 14/276,507

(22) Filed: May 13, 2014

(65) Prior Publication Data

US 2015/0330632 A1 Nov. 19, 2015

(51) Int. Cl.

| | |
|---|---|
| ***F24H 9/20*** | (2006.01) |
| ***F23Q 9/12*** | (2006.01) |
| ***F24H 1/18*** | (2006.01) |
| ***F23Q 9/08*** | (2006.01) |

(52) U.S. Cl.

CPC ..... *F23Q 9/12* (2013.01); *F23Q 9/08* (2013.01); *F24H 1/186* (2013.01); *F24H 9/205* (2013.01); *F24H 9/2021* (2013.01); *F24H 9/2035* (2013.01)

(58) Field of Classification Search

USPC ..... 431/281; 122/14.21

See application file for complete search history.

(56) References Cited

U.S. PATENT DOCUMENTS

| | | | | |
|---|---|---|---|---|
| 4,007,872 | A * | 2/1977 | Branson | F23N 1/007 236/15 A |
| 4,104,016 | A * | 8/1978 | Baysinger | F23N 5/025 431/46 |
| 4,111,640 | A * | 9/1978 | Scott | F23N 5/027 431/46 |
| 4,778,378 | A * | 10/1988 | Dolnick | F23N 5/082 136/253 |
| 5,203,688 | A * | 4/1993 | Dietiker | F23N 5/107 137/66 |
| 6,182,944 | B1 | 2/2001 | Veronese et al. | |
| 6,745,725 | B2 | 6/2004 | Toniolo et al. | |
| 7,044,023 | B2 | 5/2006 | Toniolo et al. | |
| 7,073,524 | B2 | 7/2006 | Chian | |
| 7,252,502 | B2 | 8/2007 | Munsterhuis | |
| 7,435,081 | B2 | 10/2008 | Munsterhuis | |
| 8,479,759 | B2 | 7/2013 | Benvenuto et al. | |
| 2012/0153200 | A1 | 6/2012 | Turrin et al. | |
| 2012/0160186 | A1 | 6/2012 | Turrin | |

* cited by examiner

*Primary Examiner* — Avinash Savani

(74) *Attorney, Agent, or Firm* — Armstrong Teasdale LLP

(57) ABSTRACT

A gas flow controller for use in a gas fired apparatus includes an actuator, a pilot valve operably connected to the actuator, a main burner valve, and a flow controller valve operably connected to the actuator. The pilot valve is moveable from a closed position to an open position by actuation of the actuator to provide selective fluid communication between a gas inlet and a first fluid chamber. The main burner valve provides selective fluid communication between the first fluid chamber and a main burner outlet. The flow controller valve is moveable from a closed position to an open position by actuation of the actuator to provide selective fluid communication between the gas inlet and a back side of the main burner valve to maintain the main burner valve in a closed position when the pilot valve is in the open position.

20 Claims, 6 Drawing Sheets

GAS FLOW CONTROLLER FOR USE IN GAS FIRED APPARATUS

FIELD

The field of the disclosure relates generally to gas fired apparatus, and more particularly, to gas flow controllers for use in gas fired apparatus.

BACKGROUND

Gas fired apparatus, such as residential gas fired water heaters, often include a main gas burner to provide heat for the apparatus, and a pilot burner that provides a standing pilot flame to ignite the main gas burner (e.g., for the first time or if the main burner flame goes out). In the case of water heaters, a main gas burner is used to heat water within a water tank of the water heater. A thermostat is typically provided to control the temperature of the water inside the tank and typically may be set within a particular range (e.g., warm, hot or very hot). A pilot burner provides a standing pilot flame to ignite the main gas burner.

To ignite the pilot flame in typical gas fired apparatus, a user holds a pilot valve open to permit gas to flow to the pilot burner, and ignites the gas at the pilot burner with an ignition source, such as an electronic igniter or a match. A main burner valve which controls the flow of gas to the main burner is typically closed when the pilot light is being lit. However, abnormal operating conditions may cause the main burner valve to be open when the pilot light is being lit, allowing combustible gases to flow to the main burner and creating hazardous ignition conditions.

At least some known gas flow controllers lack redundancy during the pilot lighting sequence, or are subject to potential software failure modes. Additionally, at least some known gas flow controllers utilize electronically controlled valves and/or relatively large valves as safety features, which add to the size, complexity, and cost of the gas flow controllers.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a gas flow controller for use in a gas fired apparatus including a pilot burner and a main burner is provided. The gas flow controller includes an actuator, a pilot valve operably connected to the actuator, a main burner valve, and a flow controller valve operably connected to the actuator. The pilot valve is moveable from a closed position to an open position by actuation of the actuator to provide selective fluid communication between a gas inlet and a first fluid chamber. The first fluid chamber is in fluid communication with a pilot burner outlet. The main burner valve provides selective fluid communication between the first fluid chamber and a main burner outlet. The flow controller valve is moveable from a closed position to an open position by actuation of the actuator to provide selective fluid communication between the gas inlet and a back side of the main burner valve to maintain the main burner valve in a closed position when the pilot valve is in the open position.

In another aspect, a gas flow controller for use in a gas fired apparatus including a pilot burner and a main burner is provided. The gas flow controller includes an actuator, a pilot valve operable to open and close a first fluid flow path between a gas inlet and the pilot burner upon actuation of the actuator, a main burner valve operable to open and close a second fluid flow path between the gas inlet and the main burner, and a flow controller valve operable to open and close a third fluid flow path between the gas inlet and a back side of the main burner valve upon actuation of the actuator.

In yet another aspect, a gas flow controller for use in a gas fired apparatus including a pilot burner and a main burner is provided. The gas flow controller includes a pilot valve operable to open and close a first fluid flow path between a gas inlet and the pilot burner, a main burner valve operable to open and close a second fluid flow path between the gas inlet and the main burner, a flow controller valve, a manual actuator operably connected to the pilot valve and the flow controller valve, a latch, and a pressure control valve. The main burner valve separates a first fluid chamber in fluid communication with a front side of the main burner valve from a second fluid chamber in fluid communication with the back side of the main burner valve. The first fluid chamber is fluidly connected to the second fluid chamber by a third fluid flow path including at least one pressure regulating orifice. The flow controller valve is operable to open and close a fourth fluid flow path between the gas inlet and the second fluid chamber to maintain the main burner valve in a closed position when the pilot valve is in an open position. The manual actuator is configured to open both the pilot valve and the flow controller valve when manually actuated from a first position to a second position. The latch is configured to maintain the pilot valve in the open position when the manual actuator is in the first position. The pressure control valve is configured to open and close the main burner valve by regulating a pressure differential across the front side and the back side of the main burner valve.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

DETAILED DESCRIPTION

Figure 1:
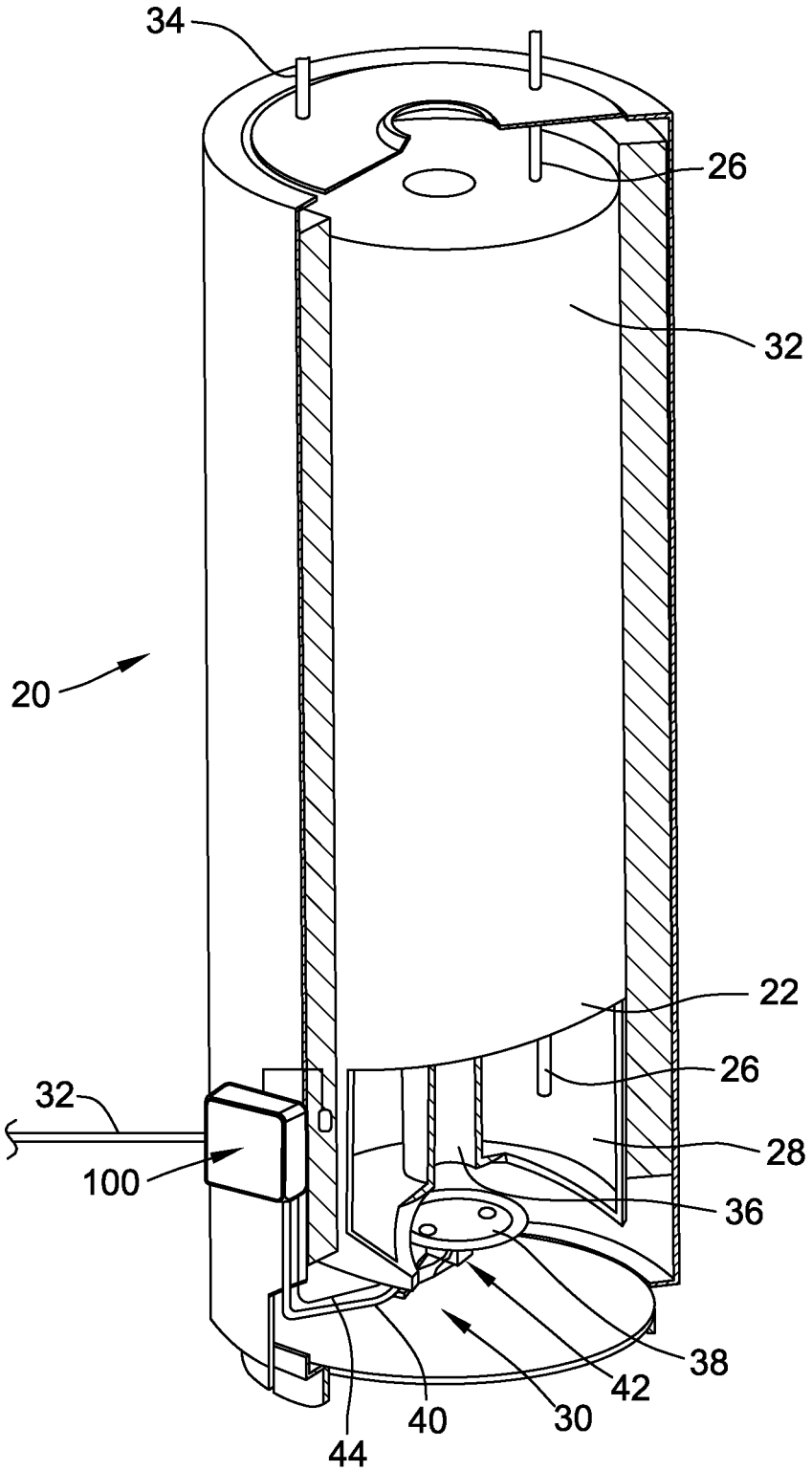
FIG. 1 is a cut-away view of a gas fired apparatus shown in the form of a water heater system, the water heater system including a gas flow controller for controlling the supply of gas in the water heater system.

Referring to FIG. 1, a gas fired apparatus illustrated in the form of a water heater system for heating and storing water is indicated generally at 20. Water heater system 20 generally includes a storage tank 22, a gas fired burner assembly 30 positioned beneath storage tank 22 for heating water supplied to and stored in storage tank 22, and a controller 100 for controlling the supply of gas to main burner assembly 30. Storage tank 22 receives cold water via a cold water inlet 26 in a bottom portion 28 of storage tank 22. Cold water entering bottom portion 28 of storage tank 22 is heated by burner assembly 30. Water that is heated leaves storage tank 22 via a hot water outlet pipe 34. Combustion gases from burner assembly 30 leave water heater system 20 via a flue 36.

Controller 100 is connected to a gas supply (not shown) via a main gas supply line 32. Controller 100 is configured to control the supply of gas from main gas supply line 32 to burner assembly 30, as described in more detail herein.

Burner assembly 30 includes a main burner 38 connected to controller 100 via a gas supply line 40 and a pilot burner 42 for igniting main burner 38. Pilot burner 42 is also configured to detect whether a pilot flame is present or extinguished, and communicate with controller 100 via connection 44 to control the supply of gas to main burner 38 (e.g., by shutting off the supply of gas if no pilot flame is detected).

Figure 2:
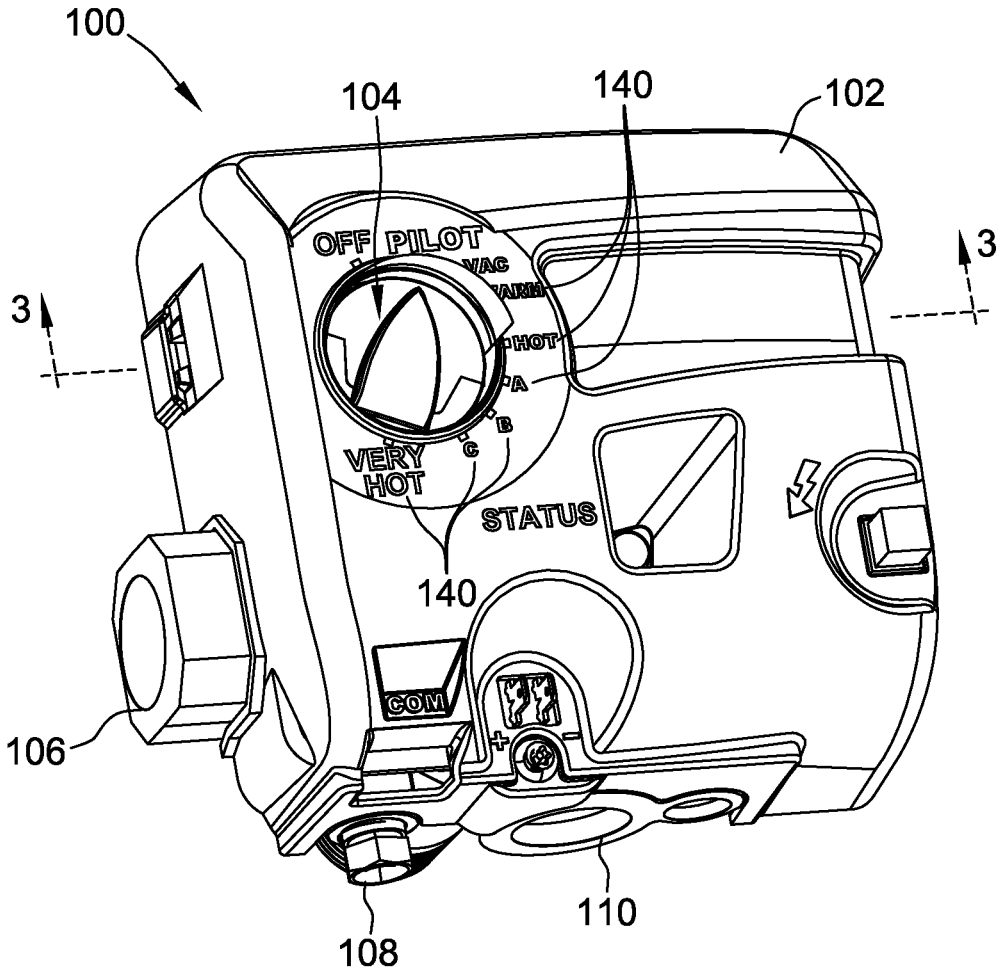
FIG. 2 is a perspective view of the controller shown in FIG. 1.
Figure 3:
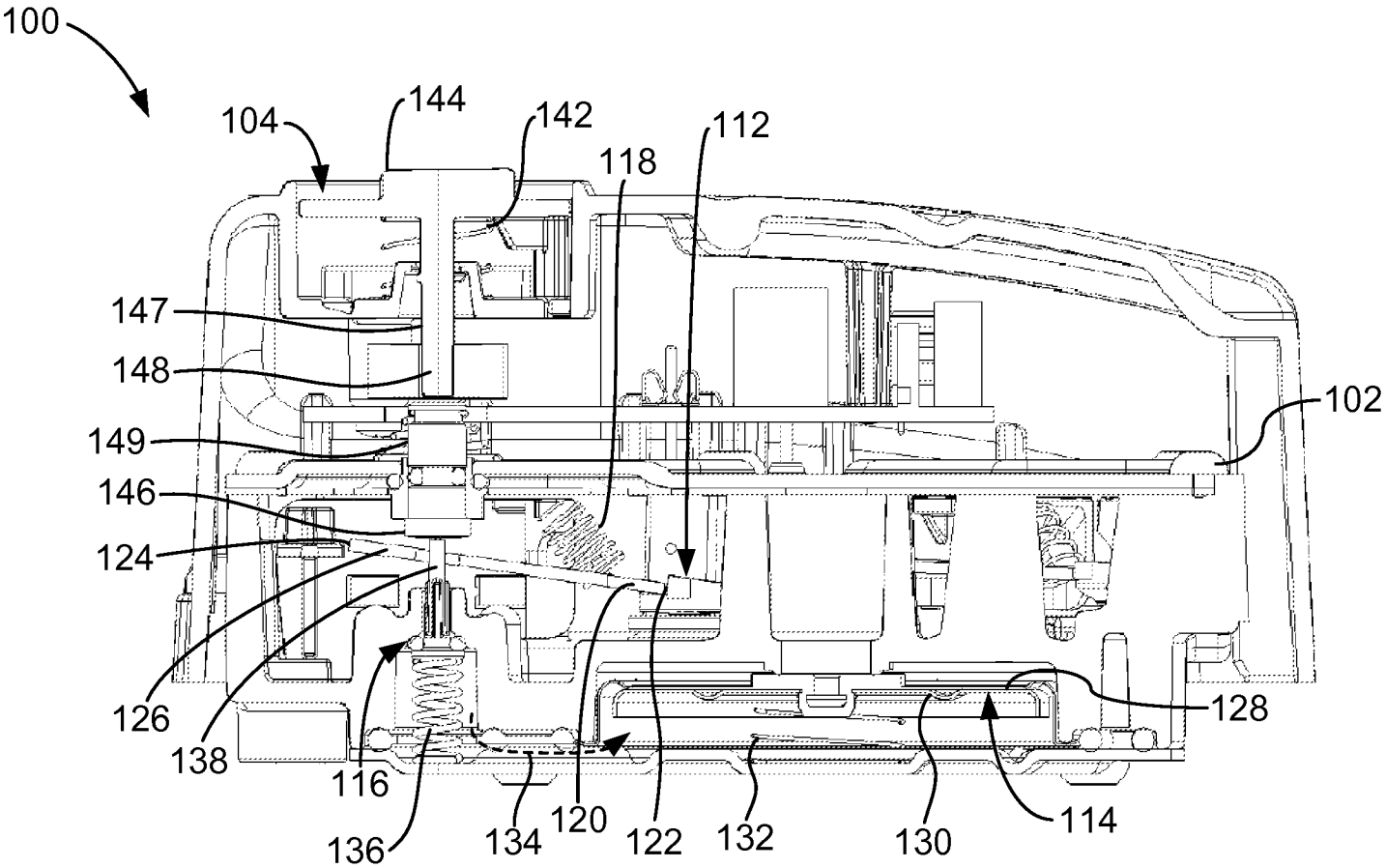
FIG. 3 is a cross-section of the controller shown in FIG. 2, taken along line "3-3" in FIG. 2.

FIG. 2 is a perspective view of controller 100, and FIG. 3 is a cross-section of controller 100 taken along line "3-3" in FIG. 2. As shown in FIGS. 2 and 3, controller 100 includes a housing 102, an input device 104, a gas inlet 106, a pilot burner outlet 108, a main burner outlet 110, a pilot valve 112 (broadly, a first valve), a main burner valve 114 (broadly, a second valve), and a flow controller valve 116 (broadly, a third valve). Controller 100 may also include an electronic controller (not shown) configured to send and receive electronic signals to and from one or more electronic components of water heater system 20.

Controller 100 is configured to control the supply of gas to pilot burner 42 and main burner 38 (both shown in FIG. 1) through pilot burner outlet 108 and main burner outlet 110, respectively, based on an operational state of controller 100.

Gas inlet 106 is configured to be connected to main gas supply line 32 (shown in FIG. 1), and to receive gas from main gas supply line 32. Pilot burner outlet 108 is configured to be fluidly connected to pilot burner 42 (shown in FIG. 1) to supply gas thereto. Main burner outlet 110 is configured to be fluidly connected to main burner 38 (shown in FIG. 1) to supply gas thereto.

Pilot valve 112 is configured to control the flow of gas from gas inlet 106 to pilot burner outlet 108. More specifically, pilot valve 112 is moveable between an open position, in which gas is permitted to flow from gas inlet 106 to pilot burner outlet 108, and a closed position (shown in FIG. 3) in which pilot valve 112 inhibits gas flow from gas inlet 106 to pilot burner outlet 108. Controller 100 includes a pilot valve spring 118 (broadly, a biasing element) configured to bias pilot valve 112 towards the closed position.

Pilot valve 112 is operably connected to input device 104 by an interconnecting member 120, which is operable to open pilot valve 112 upon actuation of input device 104, as described in more detail herein. In the illustrated embodiment, interconnecting member 120 has a fixed end 122 connected to pilot valve 112, and a second, free end 124 distal from the fixed end 122. Interconnecting member 120 also has an aperture 126 defined therein for receiving a component of flow controller valve 116, as described in more detail herein. Interconnecting member 120 is configured to pivot about a fulcrum defined by housing 102 to open pilot valve 112.

Main burner valve 114 is configured to control the flow of gas from gas inlet 106 to main burner outlet 110. More specifically, main burner valve 114 is moveable between an open position, in which gas is permitted to flow from gas inlet 106 to main burner outlet 110, and a closed position (shown in FIG. 3) in which main burner valve 114 inhibits gas flow from gas inlet 106 to main burner outlet 110. In the illustrated embodiment, main burner valve 114 is a diaphragm valve, although main burner valve 114 may be any suitable valve that enables controller 100 to function as described herein.

Main burner valve 114 includes a front side 128 and an opposing back side 130. As described in more detail herein, main burner valve 114 may be opened and closed by regulating a pressure differential across front side 128 and back side 130 of main burner valve 114. Controller 100 includes a main burner valve spring 132 (broadly, a biasing element) configured to bias main burner valve 114 towards the closed position. Main burner valve spring 132 engages back side 130 of main burner valve 114, and exerts a biasing force on back side 130 of main burner valve 114.

Flow controller valve 116 is configured to control the flow of gas from gas inlet 106 to back side 130 of main burner valve 114 through a fluid flow path 134 which provides inlet pressure gas directly to back side 130 of main burner valve 114. More specifically, flow controller valve 116 is moveable between an open position, in which gas is permitted to flow from gas inlet 106 through fluid flow path 134 to back side of main burner valve 114, and a closed position in which flow controller valve 116 inhibits gas flow through fluid flow path 134 to back side 130 of main burner valve 114. Controller 100 includes a flow controller valve spring 136 (broadly, a biasing element) configured to bias flow controller valve 116 towards the closed position.

Flow controller valve 116 is operably connected to input device 104 such that actuation of input device 104 (described below) causes both flow controller valve 116 and pilot valve 112 to open. Thus, when a user actuates input device 104 during a pilot ignition sequence (described below), flow controller valve 116 is opened by actuation of input device, and permits inlet pressure gas to flow directly to back side 130 of main burner valve 114. Flow controller valve 116 and fluid flow path 134 thereby facilitate maintaining main burner valve 114 in the closed position, inhibiting gas flow to main burner 38 when a pilot flame is being lit, and reducing the risk of hazardous ignition conditions. In the illustrated embodiment, flow controller valve 116 is operably connected to input device 104 by a valve stem 138, which extends through aperture 126 defined within interconnecting member 120 and engages input device 104.

Input device 104 is configured to receive an input from a user of controller 100. In the illustrated embodiment, for example, input device 104 includes a rotary device that enables a user to select one of a plurality of temperature setpoints 140 by rotating input device 104 to the desired temperature setpoint 140. Temperature setpoints 140 may correspond to a desired temperature of water stored within storage tank 22 (shown in FIG. 1). Controller 100 is configured to control the supply of gas to main burner 38 (shown in FIG. 1) based at least in part on a user input received at input device 104. In the illustrated embodiment, for example, controller 100 is configured to open main burner valve 114 and supply gas to main burner 38 when controller 100 determines that a temperature of water within storage tank 22 is below a user-selected temperature setpoint 140.

Further, input device 104 is an actuator configured to open both pilot valve 112 and flow controller valve 116. Accordingly, input device 104 is interchangeably referred to herein as an actuator. More specifically, input device 104 is movable from a first position (shown in FIG. 3) to a second position, and is operably connected to pilot valve 112 and flow controller valve 116 such that both pilot valve 112 and flow controller valve 116 are opened when input device 104 is actuated from the first position to the second position. Controller 100 includes an input device spring 142 (broadly, a biasing member) configured to bias input device 104 towards the first position.

In the illustrated embodiment, input device 104 is a manually actuated actuator. Specifically, input device 104 is depressible or movable (e.g., by a user) from the first position to the second position. In some embodiments, input device 104 may be keyed with housing 102 such that input device 104 is only depressible or movable when oriented in certain positions (e.g., the "pilot" position illustrated in FIG. 2).

Input device 104 includes a first end 144, an opposing second end 146 and an elongate shaft 148 extending between first end 144 and second end 146. First end 144 of input device 104 is configured to be manually actuated by a user of controller 100, and second end 146 of input device 104 is configured to engage interconnecting member 120 to open pilot valve 112. Further, second end 146 of input device 104 is configured to engage valve stem 138 to open flow controller valve 116. In the illustrated embodiment, input device 104 includes a first piece 147 and a second piece 149. First piece 147 includes first end 144 and elongate shaft 148, and second piece 149 includes second end 146. In other suitable embodiments, input device 104 may have a unitary construction. In yet other suitable embodiments, input device 104 may have any suitable configuration that enables controller 100 to function as described herein.

When input device 104 is depressed, second end 146 of input device 104 engages interconnecting member 120. Interconnecting member 120 acts as a lever, pivoting about a fulcrum defined by housing 102, and causes pilot valve 112 to open. Further, when input device 104 is depressed, second end 146 of input device 104 engages valve stem 138 of flow controller valve 116, and causes flow controller valve 116 to open. In the illustrated embodiment, flow controller valve spring 136 biases flow controller valve 116 (specifically, the stem of flow controller valve 116) against second end 146 of input device 104, and maintains engagement between input device 104 and flow controller valve 116.

Figure 4:
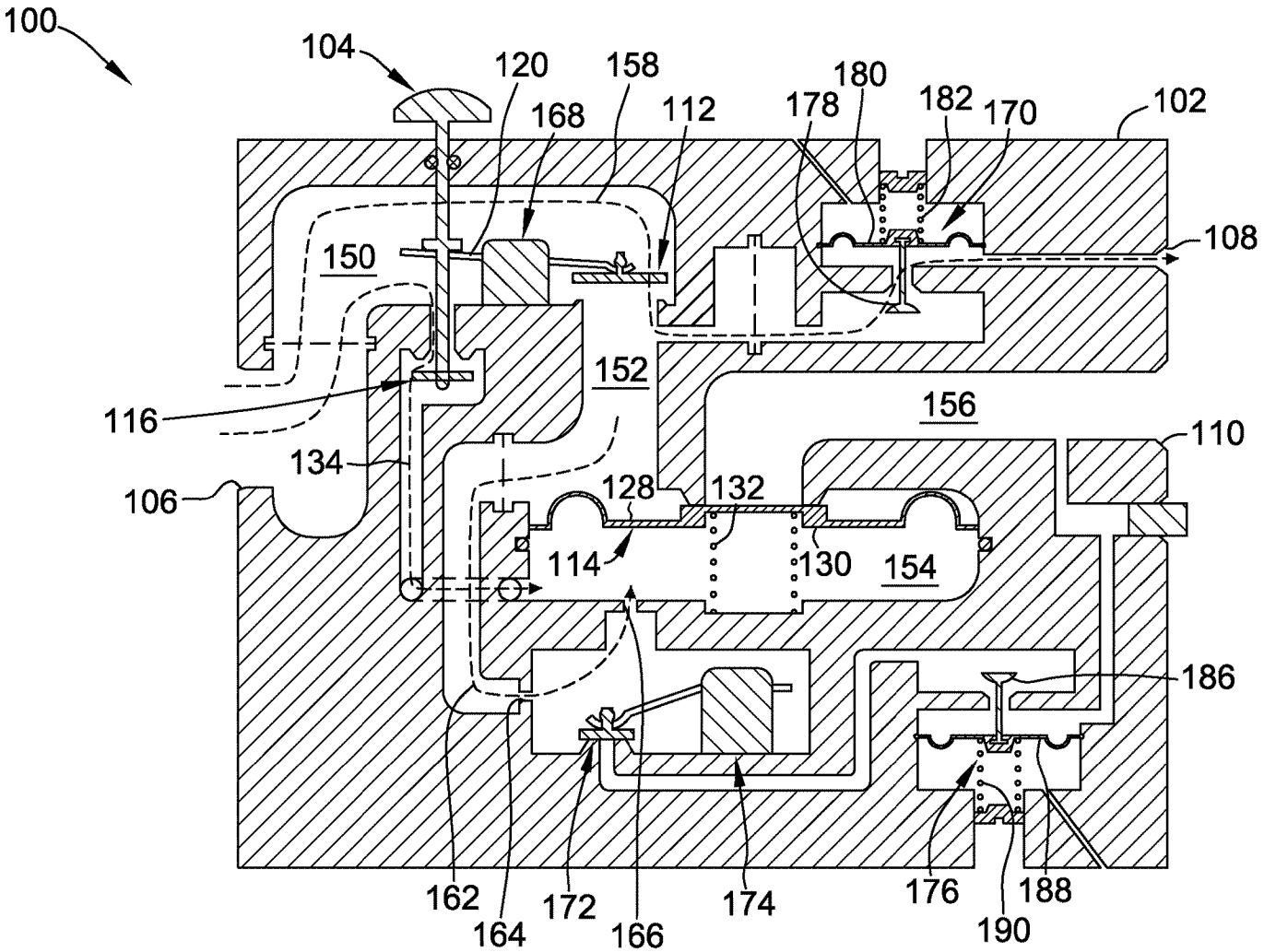
FIG. 4 is a schematic view of the controller shown in FIG. 2, shown in a pilot ignition state.
Figure 5:
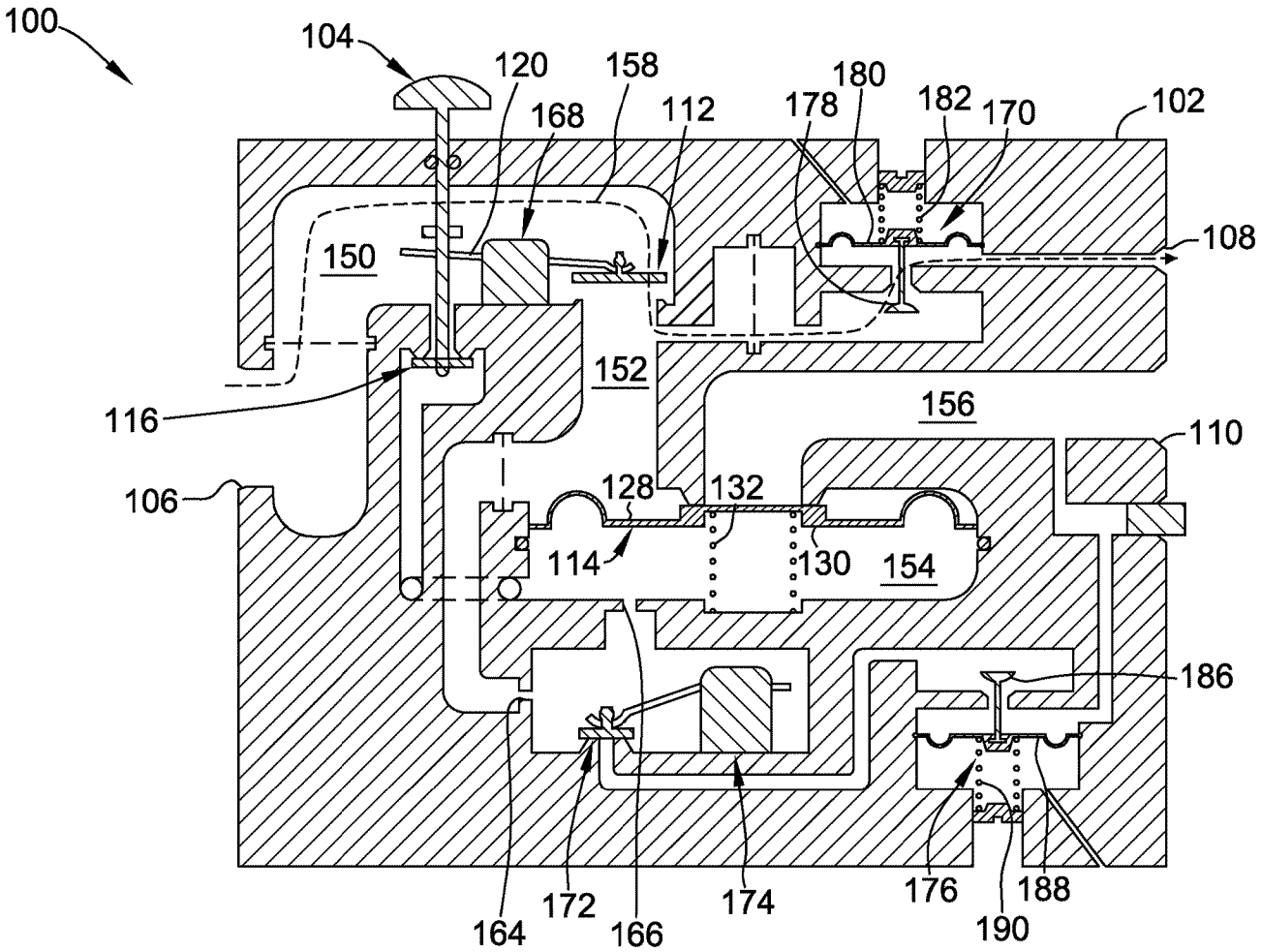
FIG. 5 is a schematic view of the controller shown in FIG. 2, shown in a standby state.
Figure 6:
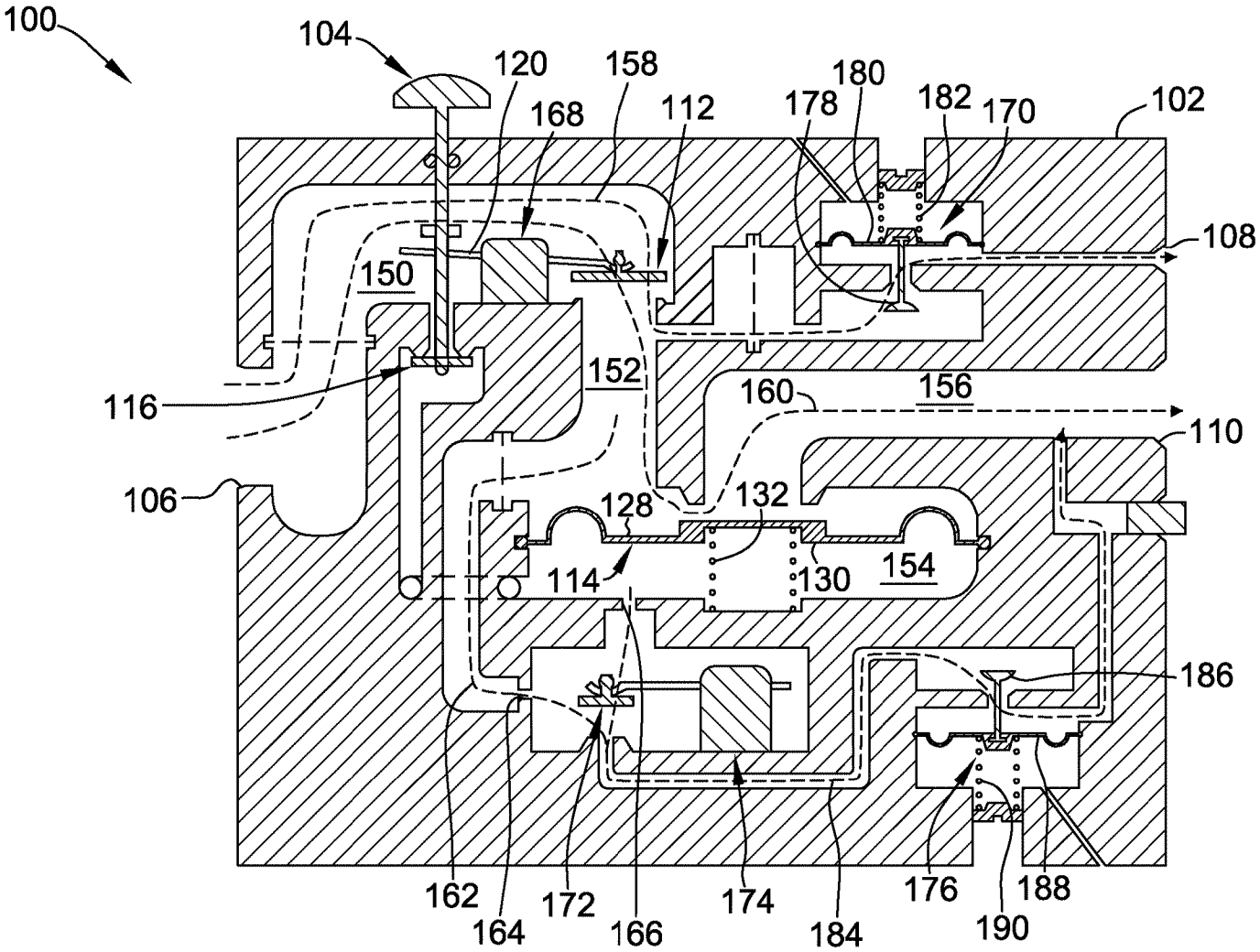
FIG. 6 is a schematic view of the controller shown in FIG. 2, shown in a main burner on state.

FIGS. 4-6 are schematic views of controller 100 in various operational states. FIG. 4 shows controller 100 in a pilot ignition state, FIG. 5 shows controller 100 in a standby state, and FIG. 6 shows controller 100 in a state in which main burner valve 114 is open, also referred to as a "main burner on" state. Components of controller 100 shown in FIGS. 4-6 are identified using the same reference numerals as used in FIGS. 2-3.

As shown in FIGS. 4-6, gas inlet 106, pilot burner outlet 108, and main burner outlet 110 are fluidly connected to one another by a plurality of fluid flow paths and chambers defined within housing 102. In the example embodiment, housing 102 defines a first fluid chamber 150, a second fluid chamber 152, a third fluid chamber 154, and a fourth fluid chamber 156. Additionally, housing 102 defines a first fluid flow path 158 from gas inlet 106 to pilot burner outlet 108, a second fluid flow path 160 from gas inlet 106 to main burner outlet 110, fluid flow path 134 (also referred to herein as third fluid flow path) from gas inlet 106 to back side 130 of main burner valve 114 and third fluid chamber 154, and a fourth fluid flow path 162 from second fluid chamber 152 to third fluid chamber 154. A portion of third fluid flow path 134 is illustrated in broken lines in FIGS. 4-6 to indicate that third fluid flow path 134 extends out of the plane in which the schematic cross-section is taken. Third fluid flow path 134 is illustrated in this way to indicate that third fluid flow path 134 does not intersect fourth fluid flow path 162 along the portion illustrated in broken lines.

Pilot valve 112 separates first fluid chamber 150 from second fluid chamber 152, and provides selective fluid communication between first fluid chamber 150 and second fluid chamber 152 by moving between the open position (shown in FIG. 4) and the closed position (shown in FIG. 3). Pilot valve 112 also provides selective fluid communication between gas inlet 106, which is fluidly connected to first fluid chamber 150, and pilot burner outlet 108, which is fluidly connected to second fluid chamber 152. When pilot valve 112 is in the open position, gas supplied to gas inlet 106 (e.g., by main gas supply line 32, shown in FIG. 1) flows from gas inlet 106 along first fluid flow path 158 to pilot burner outlet 108. Pilot valve 112 is operable to open and close first fluid flow path 158 by moving between the open and closed positions. Further, when pilot valve 112 is in the open position, gas supplied to gas inlet 106 is permitted to flow along fourth fluid flow path 162, which fluidly connects second fluid chamber 152 to third fluid chamber 154.

Main burner valve 114 separates second fluid chamber 152 from third fluid chamber 154. Second fluid chamber 152 is in fluid communication with front side 128 of main burner valve 114, and third fluid chamber 154 is in fluid communication with back side 130 of main burner valve 114. As noted above, second fluid chamber 152 is fluidly connected to third fluid chamber 154 by fourth fluid flow path 162. Fourth fluid flow path 162 includes a first pressure regulating orifice 164 and a second pressure regulating orifice 166. First and second pressure regulating orifices 164 and 166 are configured to regulate a pressure on back side 130 of main burner valve 114 to facilitate opening and closing main burner valve 114.

Main burner valve 114 also separates second fluid chamber 152 from fourth fluid chamber 156, and provides selective fluid communication between second fluid chamber 152 and fourth fluid chamber 156 by moving between the closed position (shown in FIG. 4) and the open position (shown in FIG. 6). Main burner valve 114 also provides selective fluid communication between second fluid chamber 152 and main burner outlet 110, which is fluidly connected to fourth fluid chamber 156. When main burner valve 114 and pilot valve 112 are in the open position (shown in FIG. 6), gas supplied to gas inlet 106 flows from gas inlet 106 along second fluid flow path 160 to main burner outlet 110. Main burner valve 114 is operable to open and close second fluid flow path 160 by moving between the open and closed positions.

Flow controller valve 116 provides selective fluid communication between first fluid chamber 150 and third fluid chamber 154 by moving between the open position (shown in FIG. 4) and the closed position (shown in FIG. 5). Flow controller valve 116 also provides selective fluid communication between gas inlet 106, which is fluidly connected to first fluid chamber 150, and back side 130 of main burner valve 114, which is in fluid communication with third fluid chamber 154. When flow controller valve 116 is in the open position, gas supplied to gas inlet 106 flows from gas inlet 106 along third fluid flow path 134 to third fluid chamber 154. In other words, when flow controller valve 116 is open, inlet pressure gas is supplied to back side 130 of main burner valve 114 through third fluid flow path 134. Flow controller valve 116 is operable to open and close third fluid flow path 134 by moving between the open and closed positions.

Further, in the example embodiment, controller 100 also includes a latch 168, a pilot burner flow regulator 170, a pressure control valve 172, a pressure control valve actuator 174, and a main burner flow regulator 176.

Latch 168 is operably connected to pilot valve 112, and is configured to hold pilot valve 112 in the open position when a pilot flame is present at pilot burner 42. In other words, latch 168 is configured to maintain pilot valve 112 in the open position when input device 104 is in the first position (e.g., a non-depressed position, shown in FIG. 3) and flow controller valve 116 is in the closed position. In one suitable embodiment, for example, an electronic controller within controller 100 receives a signal from a thermo-electric device indicating the presence of a pilot flame at pilot burner 42, and the electronic controller transmits a signal to latch 168 to maintain pilot valve 112 in the open position. In the example embodiment, latch 168 includes an electromagnetic element configured to cooperate with a magnetic element within pilot valve 112 to maintain pilot valve 112 in an open position. In other suitable embodiments, latch 168 may have any suitable configuration that enables controller 100 to function as described herein.

Pilot burner flow regulator 170 is configured to control the flow rate of gas to pilot burner 42. More specifically, pilot burner flow regulator 170 is configured to constrict the flow of gas along first fluid flow path 158 if the flow rate exceeds a certain flow rate. In the illustrated embodiment, pilot burner flow regulator 170 includes a poppet valve 178 connected to a diaphragm valve 180, and a flow regulator spring 182 connected to diaphragm valve 180. Gas flowing through first fluid flow path 158 exerts a pressure on a front side of diaphragm valve 180, causing diaphragm valve 180 to pull poppet valve 178 towards a closed position. As the fluid flow rate along first fluid flow path 158 increases, the pressure on a front side of diaphragm valve 180 increases and causes diaphragm valve to pull poppet valve 178 towards a closed position, thereby restricting fluid flow along first fluid flow path 158. As the fluid flow rate along first fluid flow path 158 decreases, the pressure on the front side of diaphragm valve 180 decreases, allowing poppet valve 178 to move towards an open position and permitting a greater fluid flow rate along first fluid flow path 158.

Pressure control valve 172 is configured to open and close main burner valve 114 by regulating a pressure differential across front side 128 and back side 130 of main burner valve 114. More specifically, pressure control valve 172 is configured to open and close a fifth fluid flow path 184 (shown in FIG. 6) fluidly connecting fourth fluid chamber 156 to second fluid chamber 152 and third fluid chamber 154. When pressure control valve 172 is open (shown in FIG. 6), gas within third fluid chamber 154 is permitted to flow away from back side 130 of main burner valve 114 and into fourth fluid chamber 156, thereby increasing the pressure differential between front side 128 and back side 130 of main burner valve 114. First pressure regulating orifice 164, second pressure regulating orifice 166, and fifth fluid flow path 184 are configured (e.g., sized and shaped) to permit sufficient fluid flow away from back side 130 of main burner valve 114 such that, when pressure control valve 172 is open, the pressure differential between front side 128 and back side 130 of main burner valve 114 is sufficient to overcome the biasing force of main burner valve spring 132, and cause main burner valve 114 to open.

Pressure control valve 172 is operably connected to pressure control valve actuator 174. Pressure control valve actuator 174 is configured to open and close pressure control valve 172. In the illustrated embodiment, pressure control valve actuator 174 is an electronic actuator configured to open and close pressure control valve 172 in response to signals received from an electronic controller within controller 100. For example, when controller 100 determines the water temperature of water stored within storage tank 22 (shown in FIG. 1) is below a threshold temperature (e.g., a user-selected temperature setpoint 140, shown in FIG. 2), an electronic controller within controller 100 may send a signal to pressure control valve actuator 174 to open pressure control valve 172, thereby causing main burner valve 114 to open and allowing gas to flow to main burner 38. Pressure control valve actuator 174 may include any suitable actuator that enables controller 100 to function as described herein. In the example embodiment, pressure control valve actuator 174 is a solenoid actuator.

Main burner flow regulator 176 is configured to control the flow rate of gas to main burner 38 (shown in FIG. 1) by controlling the extent to which main burner valve 114 is open. More specifically, main burner flow regulator 176 is configured to control the flow rate of gas along fifth fluid flow path 184, thereby controlling the rate of gas flow away from back side 130 of main burner valve 114 and the pressure on back side 130 of main burner valve 114. In the illustrated embodiment, main burner flow regulator 176 includes a poppet valve 186 connected to a diaphragm valve 188, and a flow regulator spring 190 connected to diaphragm valve 188. Gas flowing through fifth fluid flow path 184 exerts a pressure on a front side of diaphragm valve 188, causing diaphragm valve 188 to pull poppet valve 186 towards a closed position. As the fluid flow rate along fifth fluid flow path 184 increases, the pressure on the front side of diaphragm valve 188 increases and causes diaphragm valve to pull poppet valve 186 towards a closed position, thereby restricting fluid flow along fifth fluid flow path 184. As the fluid flow rate along fifth fluid flow path 184 decreases, the pressure on the front side of diaphragm valve 188 decreases, allowing poppet valve 186 to move towards an open position and permitting a greater fluid flow rate along fifth fluid flow path 184.

Under normal operating conditions, when controller 100 is in the pilot ignition state (shown in FIG. 4), the pressure on back side 130 of main burner valve 114 (e.g., the pressure within third fluid chamber 154) combined with the biasing force of main burner valve spring 132 is sufficient to maintain main burner valve 114 in the closed position. In other words, second fluid flow path 160 is closed off by main burner valve 114 under normal operating conditions such that when the pilot light is being lit, no gas flows to main burner 38 (shown in FIG. 1).

Under abnormal operating conditions, for example, where one or both of pressure regulating orifices 164 and 166 are partially or totally blocked or where pressure control valve 172 is open in the pilot ignition state, main burner valve 114 may be open in the pilot ignition state, allowing gas to flow to main burner 38 (shown in FIG. 1). The flow of gas to main burner 38 during pilot lighting may create hazardous ignition conditions.

Third fluid flow path 134 is configured (e.g., size and shaped) to permit sufficient fluid flow to back side 130 of main burner valve 114 such that the resulting pressure on back side 130 of main burner valve 114 combined with the biasing force of main burner valve spring 132 is sufficient to maintain main burner valve 114 in the closed position, even under abnormal operating conditions. (e.g., where one or both of pressure regulating orifices 164 and 166 are blocked, or where pressure control valve 172 is open in the pilot ignition state). Thus, when input device 104 is actuated by a user (e.g., during pilot lighting), flow controller valve 116 and third fluid flow path 134 facilitate maintaining main burner valve 114 in the closed position, and inhibiting gas flow to main burner 38.

In one suitable embodiment, for example, third fluid flow path 134 has a fluid flow rating that is greater than a fluid flow rating of fourth fluid flow path 162. As used herein, the term "fluid flow rating" refers to the fluid flow rate through a fluid flow path under a standard pressure differential across the fluid flow path (e.g., 1 atmosphere). The fluid flow rate may be a volumetric flow rate or a mass flow rate. For example, the fluid flow rating of third fluid flow path 134 may be between about 1% and 500% greater than the fluid flow rating of fourth fluid flow path 162. In another suitable embodiment, a flow-limiting cross-sectional area of third fluid flow path 134 (e.g., the minimum cross-sectional area of third fluid flow path 134 taken along a plane normal to the direction of fluid flow) is greater than a flow-limiting cross-sectional area of fourth fluid flow path 162. In one suitable embodiment, for example, the flow-limiting cross-sectional area of third fluid flow path 134 is at least about 1.5 times greater than the flow-limiting cross-sectional area of fourth fluid flow path 162, more suitably at least about 2.5 times greater than the flow-limiting cross-sectional area of fourth fluid flow path 162, and, even more suitably, at least about 4 times greater than the flow-limiting cross-sectional area of fourth fluid flow path 162. The flow-limiting cross-sectional area of fourth fluid flow path 162 may correspond to one of first pressure regulating orifice 164 and second pressure regulating orifice 166. In the illustrated embodiment, for example, the flow-limiting cross-sectional area of fourth fluid flow path 162 corresponds to first pressure regulating orifice 164.

In use, controller 100 is used to control the supply of gas to pilot burner 42 and main burner 38 (both shown in FIG. 1) during different operational states of controller 100. In the pilot ignition state (shown in FIG. 4), for example, controller 100 is used to safely ignite a pilot flame (e.g., for the first time or after the pilot flame has been extinguished).

To ignite a pilot flame, input device 104 is actuated (e.g., by manually depressing input device 104) from the first position to the second position to open pilot valve 112. When pilot valve 112 is open, gas supplied by main gas supply line 32 (shown in FIG. 1) flows from gas inlet 106 along first fluid flow path 158 to pilot burner outlet 108. Gas is supplied to pilot burner 42 (shown in FIG. 1) from pilot burner outlet 108, and is ignited by an igniter (not shown) included in pilot burner 42.

Further, when pilot valve 112 is held open, gas supplied to gas inlet 106 is permitted to flow into second fluid chamber 152 and into third fluid chamber 154 through pressure regulating orifices 164 and 166, creating a pressure differential across main burner valve 114. Under normal operating conditions, the pressure on back side of main burner valve 114 (e.g., the pressure within third fluid chamber 154) combined with the biasing force of main burner valve spring 132 is sufficient to maintain main burner valve 114 in the closed position. In other words, gas flow through second fluid flow path 160 is inhibited by main burner valve 114 under normal operating conditions such that when the pilot light is being lit, no gas flows to main burner 38 (shown in FIG. 1).

As shown in FIG. 4, actuation of input device 104 also causes flow controller valve 116 to open such that third fluid flow path 134 is open when pilot valve 112 is held open by input device 104. Gas supplied to gas inlet 106 is thereby permitted to flow through third fluid flow path 134 into third fluid chamber 154 and to back side 130 of main burner valve 114. As noted above, third fluid flow path 134 is configured (e.g., size and shaped) to permit sufficient fluid flow to back side 130 of main burner valve 114 such that the resulting pressure on back side 130 of main burner valve 114 combined with the biasing force of main burner valve spring 132 is sufficient to maintain main burner valve 114 in the closed position, even under abnormal operating conditions. (e.g., where one or both of pressure regulating orifices 164 and 166 are blocked, or where pressure control valve 172 is open in the pilot ignition state). The configuration of flow controller valve 116 and third fluid flow path 134 thereby facilitates maintaining main burner valve 114 in the closed position, and inhibiting gas flow to main burner 38 (shown in FIG. 1) when a pilot flame is being lit.

Once the pilot flame is ignited, input device 104 may be actuated from the second position to the first position, thereby closing flow controller valve 116. When a pilot flame is detected at pilot burner 42 (e.g., by a thermo-electric device, such as a thermopile), controller 100 enters the standby state (shown in FIG. 5). In the standby state, pilot valve 112 is held in the open position by latch 168 such that gas is continuously supplied to pilot burner 42 (shown in FIG. 1) through pilot burner outlet 108. More specifically, in the example embodiment, a thermo-electric device generates a signal to an electronic controller within controller 100 indicating the presence of a pilot flame at pilot burner 42 (shown in FIG. 1), and the electronic controller transmits a signal to latch 168 to hold pilot valve 112 in the open position. In some embodiments, latch 168 may be powered by thermal energy generated by the pilot flame, which is converted to electric energy by the thermo-electric device.

Controller 100 enters the main burner on state (shown in FIG. 6) when controller 100 receives a signal to ignite main burner 38 (shown in FIG. 1). Main burner valve 114 may be actuated by regulating a pressure differential across front side 128 and back side 130 using pressure control valve 172. In one embodiment, for example, when controller 100 receives a signal to ignite main burner 38 (e.g., from a thermostat electrically connected to controller 100), pressure control valve 172 is opened by pressure control valve actuator 174. When pressure control valve 172 is open, gas within third fluid chamber 154 is permitted to flow away from back side 130 of main burner valve 114 and into fourth fluid chamber 156, thereby increasing the pressure differential between front side 128 and back side 130 of main burner valve 114. The pressure differential between front side 128 and back side 130 in the main burner on state is sufficient to overcome the biasing force of main burner valve spring 132, thereby causing main burner valve 114 to move from the closed position to the open position. When main burner valve 114 is opened, gas is permitted to flow from gas inlet 106, through second fluid flow path 160, and out main burner outlet 110. In the example embodiment, gas supplied to main burner 38 (shown in FIG. 1) from main burner outlet 110 is ignited by a standing pilot flame provided by pilot burner 42 (shown in FIG. 1).

When controller 100 determines the supply of gas to main burner 38 should be shut off (e.g., by receiving a signal from a thermostat that a water temperature of water within storage tank 22 has reached a threshold temperature), pressure control valve 172 is closed by pressure control valve actuator 174, thereby reducing the pressure differential across front side 128 of main burner valve 114 and back side 130 of main burner valve 114. When the pressure differential is sufficiently low, the combination of the pressure on back side 130 of main burner valve 114 and the biasing force from main burner valve spring 132 causes the main burner valve 114 to close, returning controller 100 to the standby state (shown in FIG. 5).

Embodiments of the systems described herein achieve superior results as compared to prior art systems. For example, the gas flow controllers described herein provide a safety feature that facilitates inhibiting gas flow to a main burner while a pilot burner is being lit. In particular, the gas flow controllers described herein include a flow controller valve which provides selective fluid communication between a gas inlet and the back side of a main burner valve. The flow controller valve is operable to open and close a fluid flow path from the gas inlet to the back side of a main burner valve. The fluid flow path is configured to permit sufficient fluid flow to the back side of the main burner valve such that the main burner valve remains closed even under abnormal operating conditions. Further, the flow controller valve is operably connected to an actuator, which is operably connected to a pilot valve such that actuation of the actuator causes both the flow controller valve and the pilot valve to open. In other words, when the pilot valve is held open by the actuator (e.g., by a user igniting a pilot flame), the flow controller valve is also held open by the actuator, permitting gas to flow through the fluid flow path to the back side of the main burner valve. The gas flow through the fluid flow path helps maintain the main burner valve in a closed position, and thereby inhibits the flow of gas to the main burner when a pilot light is being lit.

Example embodiments of gas fired appliances, such as water heater systems, and gas flow controllers for use in such gas fired appliances are described above in detail. The system and controller are not limited to the specific embodiments described herein, but rather, components of the system and controller may be used independently and separately from other components described herein. For example, the gas flow controllers described herein may be used in gas fired apparatus other than water heaters, including without limitation furnaces, dryers and fireplaces.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing(s) shall be interpreted as illustrative and not in a limiting sense.

What is claimed is:

1. A gas flow controller for use in a gas fired apparatus including a pilot burner and a main burner, the controller comprising:

an actuator;

a pilot valve connected to the actuator, the pilot valve moveable from a closed position to an open position by actuation of the actuator to provide selective fluid communication between a gas inlet and a first fluid chamber, the first fluid chamber in fluid communication with a pilot burner outlet;

a main burner valve providing selective fluid communication between the first fluid chamber and a main burner outlet; and a flow controller valve connected to the actuator, the flow controller valve moveable from a closed position to an open position by actuation of the actuator to provide selective fluid communication between the gas inlet and a back side of the main burner valve to maintain the main burner valve in a closed position when the pilot valve is in the open position.

2. The gas flow controller of claim 1, wherein the actuator is movable from a first position to a second position, the actuator configured to open the pilot valve and the flow controller valve when moved from the first position to the second position.

3. The gas flow controller of claim 1, further comprising an interconnecting member connecting the pilot valve to the actuator, the interconnecting member having an aperture defined therein;

wherein the flow controller valve includes a valve stem configured to engage the actuator, the valve stem extending through the aperture.

4. The gas flow controller of claim 3, wherein the actuator comprises a first end configured to be manually actuated by a user, and a second end distal from the first end, the second end configured to engage the valve stem of the flow controller valve and the interconnecting member to open the flow controller valve and the pilot valve.

5. The gas flow controller of claim 1, wherein the first fluid chamber is in fluid communication with a front side of the main burner valve, the main burner valve separating the first fluid chamber from a second fluid chamber in fluid communication with the back side of the main burner valve, the first fluid chamber fluidly connected to the second fluid chamber by a fluid flow path including at least one pressure regulating orifice.

6. The gas flow controller of claim 5, further comprising a pressure control valve configured to open and close the main burner valve by regulating a pressure differential across the front side and the back side of the main burner valve.

7. The gas flow controller of claim 1, further comprising a latch connected to the pilot valve, the latch configured to maintain the pilot valve in the open position when the flow controller valve is in the closed position.

8. A gas flow controller for use in a gas fired apparatus including a pilot burner and a main burner, the controller comprising:

an actuator;

a pilot valve operable to open and close a first fluid flow path between a gas inlet and the pilot burner upon actuation of the actuator;

a main burner valve operable to open and close a second fluid flow path between the gas inlet and the main burner; and a flow controller valve operable to open and close a third fluid flow path between the gas inlet and a back side of the main burner valve upon actuation of the actuator.

9. The gas flow controller of claim 8, wherein the actuator is depressible from a first position to a second position, the actuator configured to open the pilot valve and the flow controller valve when manually depressed from the first position to the second position.

10. The gas flow controller of claim 8, further comprising an interconnecting member connecting the pilot valve to the actuator, the interconnecting member having an aperture defined therein;

wherein the flow controller valve includes a valve stem configured to engage the actuator, the valve stem extending through the aperture.

11. The gas flow controller of claim 8, wherein the main burner valve separates a first fluid chamber in fluid communication with a front side of the main burner valve from a second fluid chamber in fluid communication with the back side of the main burner valve, the first fluid chamber fluidly connected to the second fluid chamber by a fourth fluid flow path including at least one pressure regulating orifice.

12. The gas flow controller of claim 11, wherein the third fluid flow path has a fluid flow rating greater than a fluid flow rating of the fourth fluid flow path.

13. The gas flow controller of claim 11, wherein a flow-limiting cross-sectional area of the third fluid flow path is greater than a flow-limiting cross-sectional area of the fourth fluid flow path.

14. The gas flow controller of claim 11, further comprising a pressure control valve configured to open and close the main burner valve by regulating a pressure differential across the front side and the back side of the main burner valve.

15. The gas flow controller of claim 8, further comprising a latch connected to the pilot valve, the latch configured to maintain the pilot valve in the open position when the flow controller valve is in the closed position.

16. A gas flow controller for use in a gas fired apparatus including a pilot burner and a main burner, the controller comprising:

a pilot valve operable to open and close a first fluid flow path between a gas inlet and the pilot burner;

a main burner valve operable to open and close a second fluid flow path between the gas inlet and the main burner, the main burner valve separating a first fluid chamber in fluid communication with a front side of the main burner valve from a second fluid chamber in fluid communication with the back side of the main burner valve, the first fluid chamber fluidly connected to the second fluid chamber by a third fluid flow path including at least one pressure regulating orifice;

a flow controller valve operable to open and close a fourth fluid flow path between the gas inlet and the second fluid chamber to maintain the main burner valve in a closed position when the pilot valve is in an open position;

a manual actuator connected to the pilot valve and the flow controller valve, the manual actuator configured to open both the pilot valve and the flow controller valve when manually actuated from a first position to a second position;

a latch configured to maintain the pilot valve in the open position when the manual actuator is in the first position; and a pressure control valve configured to open and close the main burner valve by regulating a pressure differential across the front side and the back side of the main burner valve.

17. The gas flow controller of claim 16, wherein the fourth fluid flow path has a fluid flow rating greater than a fluid flow rating of the third fluid flow path.

18. The gas flow controller of claim 16, wherein a flow-limiting cross-sectional area of the fourth fluid flow path is greater than a flow-limiting cross-sectional area of the third fluid flow path.

19. The gas flow controller of claim 16, further comprising an interconnecting member connecting the pilot valve to the manual actuator, the interconnecting member having an aperture defined therein;

wherein the flow controller valve includes a valve stem configured to engage the manual actuator, the valve stem extending through the aperture.

20. The gas flow controller of claim 16, wherein the gas fired apparatus is a water heater.

* * * * *